United States Patent [19]

Toyama

[11] Patent Number: 4,724,578

[45] Date of Patent: Feb. 16, 1988

[54] HINGE

[75] Inventor: Hiroaki Toyama, Yamanashi, Japan

[73] Assignee: Kabushiki Kaisha Murakoshi Seiko, Tokyo, Japan

[21] Appl. No.: 921,640

[22] Filed: Oct. 22, 1986

[30] Foreign Application Priority Data

Mar. 20, 1986 [JP] Japan ..... 61-41510[U]

[51] Int. Cl.[4] ..... E05D 7/06; E05F 1/08

[52] U.S. Cl. ..... 16/240; 16/288; 16/294; 16/296; 16/385

[58] Field of Search ..... 16/239, 240, 245, 246, 16/291, 296, 288, 294, 385, DIG. 13

[56] References Cited

U.S. PATENT DOCUMENTS 3,362,042 1/1968 Salice ..... 16/291

FOREIGN PATENT DOCUMENTS 652456 3/1965 Belgium ..... 16/288
2656305 6/1978 Fed. Rep. of Germany ..... 16/288
2818735 11/1979 Fed. Rep. of Germany ..... 16/288
31269 3/1977 Japan ..... 16/DIG. 13

*Primary Examiner*—Nicholas P. Godici
*Assistant Examiner*—Edward Brown
*Attorney, Agent, or Firm*—James E. Nilles

[57] ABSTRACT

A hinge of the type wherein a rotor is connected to be rotatable to a front part of a base by first and second link arms, the base is supported by a set screw on a fitting member which is mounted on a body of furniture and at least one of the link arms is urged so as to keep the rotor closed. The one of the link arms has a cam surface that is formed on the side of the base, and the base has a frame member pushing the cam surface, so that when the rotor is closed the frame member engages the under side portion of the cam surface to urge the rotor in a direction such that the rotor is closed.

4 Claims, 3 Drawing Figures

HINGE

BACKGROUND OF THE INVENTION

1. Field of the Invention

This invention relates generally to a hinge, and more particularly to a hinge for use in the door of furniture, or the like.

2. Description of the Prior Art

In heretofore known hinges of the type wherein a rotor is connected to a front part of a base by a pair of link arms so that the rotor can be rotated and opened and closed, the base is supported by screws to a fitting member fitted to a member to be fitted and at least one of the link arms is urged to keep the rotor in the closed state, and a spring that urges one of the link arms is disposed at the front of the set screws inside the base least they become obstacles.

In the conventional structure described above, however, since the spring is disposed at the front of the set screws, a large useless space is generated at the rear of the set screws inside the base and the base itself becomes great in size.

SUMMARY OF THE INVENTION

It is an object of the present invention to provide a hinge having a construction wherein a frame member which pushes a cam surface of each link arm is supported inside the base in such a manner as to encompass the set screws and the spring urging the link arm through this frame member is disposed at the rear of the frame member in order to effectively utilize the inner space of the base and to reduce its size.

DESCRIPTION OF THE PREFERRED EMBODIMENT

Figure 1:
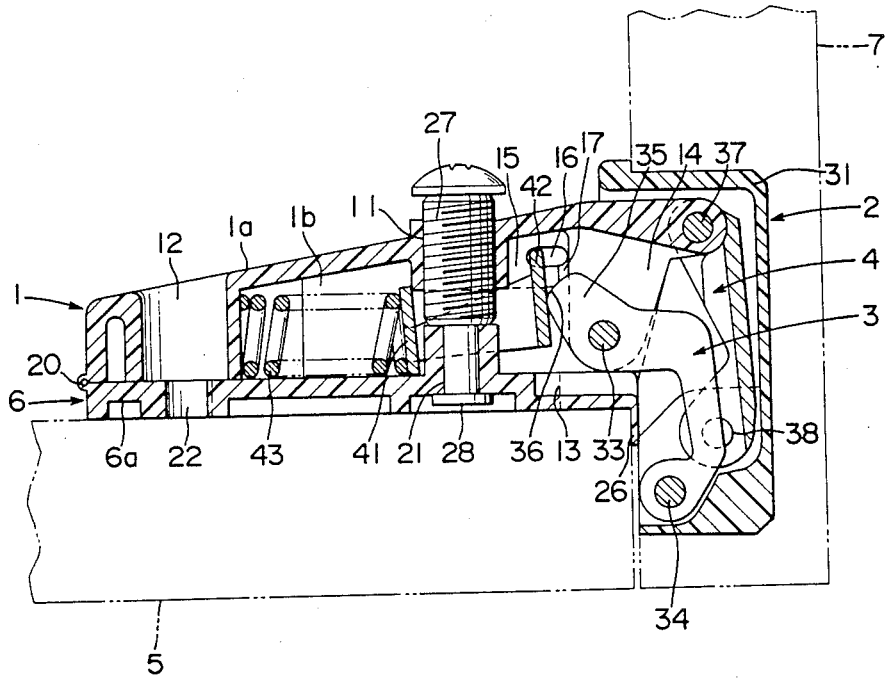
FIG. 1 is a sectional view of a hinge in a closed state in accordance with one embodiment of the present invention.
Figure 3:
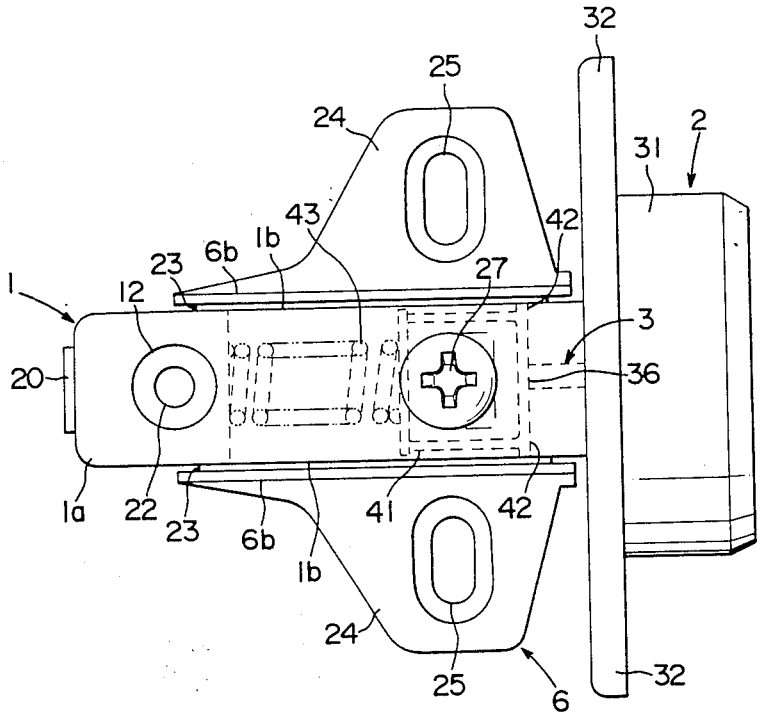
FIG. 3 is a side view of the hinge.
Figure 2:
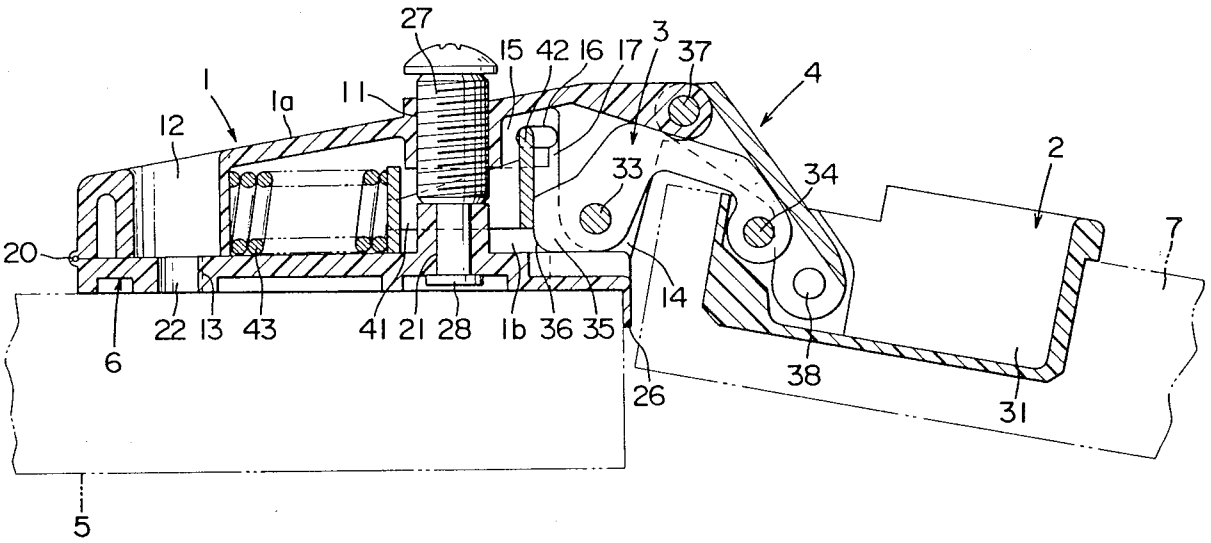
FIG. 2 is a sectional view of the hinge in its open state.

In a hinge of the present invention, a rotor 2 is connected to a front part of a base 1 by first and second rotatable link arms 3 and 4 so that the rotor 2 can rotate with respect to the base, and the base 1 is fitted to a main body 5 of furniture, or the like, by a fitting member 6 while the rotor 2 is fitted to a door 7 of the furniture or the like in such a manner that it can rotate relatively to the main body 5.

The base 1 is integrally molded from a synthetic resin and has a substantially box-like shape which is open at its lower surface. A screw hole 11 is defined at a front center of an upper sheet portion 1*a* the base 1, while a through-hole 12 extending in a vertical direction is formed at a rear end part of the base 1. Fitting recess portions 13 are formed at the lower edge portions of both side sheet portions 1*b* of the base 1. A slit portion 14 is formed at a front part of the base 1. Thick portions 15 that project inward are formed at the upper parts of both side sheet portions 1*b* of the base 1. Elongated holes 16 that extend in a longitudinal direction are bored at the upper parts of these thick portions 15. Groove portions 17 are formed on the inner surfaces of the thick portions 15 in such a manner as to extend upward from the lower edges of the thick portions and reach the front parts of the elongated holes 16.

The fitting member 6 is molded integrally with the base 1 from a synthetic resin. In other words, the base 1 and the fitting member 6 are connected integrally at their rear end portions by a hinge portion 20 having a reduced thickness so that they can rotate with each other. An engagement hole 21 is formed on a lower sheet portion 6*a* of the fitting member 6 in such a manner as to face the screw hole 11 of the base 1, and another through-holes 22 is formed at the rear of the former in such a manner as to face the through-hole 12 of the base. The side sheet portions 6*b* are formed on both sides of the lower sheet portion 6*a* of the fitting member 6 and clamp the base 1 from both sides through fitting edge portions 23 into which the fitting recess portions 13 of the base 1 are fitted. Fitting plate portions 24 are formed to project from the external sides of the side sheet portions 6*b*, and are equipped with elongated through-holes 25 that extend to the right and left. A locating plate portion 26 is formed at the front end portion of the fitting member 6 and is bent downward perpendicularly.

A set screw 27 is screwed into the screw hole 11 of the base 1 and a ring-like engagement portion 28 formed at the tip of this set screw 27 engages with the engagement hole 21 of the fitting member 6. In other words, the base 1 is supported by, and fixed to, the fitting member 6 by the set screw 27 in cooperation with the hinge portion 20 that was described already.

The rotor 2 is integrally molded from a synthetic resin, and has a cap portion 31 having one of the surfaces thereof open and sheet-like fitting portions 32 that are formed to project from both sides of the open surface of the cap portion 31. The cap portion 31 of this rotor 2 is buried in the door 7 of the furniture or the like and is fixed thereto by screws through the fitting portions 32.

The first link arm 3 is shaped from a metal sheet or the like in a substantially U-shaped form. The base end portion of the first link arm 3 is rotatably supported by a shaft 33 below and inside the slit portion 14 of the base 1, while the tip of the first link arm 3 is rotatably supported by a shaft 34 inside the cap portion 31 of the rotor 2. An extension portion 35 is formed at the base end portion of the first link arm 3 in such a manner as to extend rearward from the shaft 33, and a cam surface 36 curved in the convex form is formed on the rear surface of this extension portion 35.

The second link arm 4 is made from a metal sheet or the like in a substantially U-shaped cross-section. The base end of the second link arm 4 is rotatably supported by a shaft 37 above the front end portion of the base 1, while its tip is supported rotatably by a shaft 38 inside the cap portion 31 of the rotor 2.

Reference numeral 41 represents a frame member which is made from a metal sheet or the like in a substantially rectangular shape, and support plate portions 42 are formed to project outward from the upper end portions on both sides of its front surface as support shaft portions, respectively. When engaged with the rear end portions of both elongated holes 16 of the base 1 while encompassing the set screw 27 inside the base 1, the frame member 41 is supported rotatably in a vertical direction with the support plate portions 42 being the center. The front surface of this frame member 41 is bought into contact with the cam surface 36 of the first link arm 3.

A coil spring 43 is interposed between the rear surface of the frame member 41 and a front wall of the through-hole 12 inside the base 1 in order to always urge forward the frame member 41.

The locating plate portion 26 of the fitting member 6 is engaged with the open edge of the main body 5 of the furniture or the like and the screws are fitted to the main body 5 through the through-holes 22, 25 of the fitting member 6, whereby the base 1 is fitted to the main body 5 of the furniture or the like through this fitting member 6. The rotor 2 is fitted to the door 7 of the furniture or the like.

When the set screw 27 is suitably rotated, the base 1 is rotated relative to the fitting member 6 with the hinge portion 20 as the center, so that the angle of the base 1 relative to the fitting member 6 can be adjusted.

When the door 7 of the furniture or the like is opened or closed, the link arms 3, 4 rotate relative to the base 1 and to the rotor 2, respectively, and this rotor 2 is rotated and opened or closed. When the first link arm 3 is rotated, the frame member 41 that is urged forward by the spring 43 is somewhat rotated while its front surface is kept in contact with the cam surface 36 of the first link arm 3.

When the door 7, that is, the rotor 2, is closed, the frame member 41 is brought into contact with the portion near the lower corner of the cam surface 36 of the first link arm 3 as shown in FIG. 1. At this time, force acts upon the extension portion 35 of the first link arm 3 in a direction above the shaft 33 supporting the first link arm 3 to the base 1, with the contact point between the cam surface 36 and the frame member 41 being the point of action as shown in the drawing. In other words, the first link arm 3 is urged in the closing direction and the rotor 2 is kept closed.

When the frame member 41 is assembled to the base 1, it is placed into the base 1 from the lower open surface of the base 1 and the support plate portions 42 of the frame member 41 are then engaged with the elongated holes 16 through the groove portions 17 of the base 1. Since there are provided the groove portions 17 which the support plate portions 42 of the frame member 41 pass through, the frame member 41 can be assembled easily to the base 1.

On the other hand, when the rotor 2 is opened and closed, the contact point of the spring 43 to the frame member 41 is on the opposite side to the support plate portion 42 of the frame member 41 with respect to the contact point of the cam surface 36 of the first link arm 3 to the frame member 41, so that the spring 43 urges forward the frame member 41 and at the same time, the force also acts counter-clockwise with the contact point of the first link arm 3 to the frame member 41 being the center. In other words, the support plate portions 42 of the frame member 41 are always urged rearward.

Accordingly, the support plate portion 42 always stays at the rear part of the elongated hole 16 and does not move forth toward the front part of the elongated hole 16 containing the groove portions. Namely, although the groove portions 17 facilitate the assembly of the frame 41 as described already, the frame member 41 does not fall off once it is assembled.

As described already, the first link arm 3 is urged by the spring 43 through the frame member 41 and this frame member 41 is supported inside the base 1 in such a manner as to encompass the set screw 27. Accordingly, the set screw 27 does not become an obstacle, and the spring 43 can be disposed at the back of the set screw inside the base 1, so that the space inside the base 1 can be utilized effectively and the base 1 can be made compact. In other words, the hinge can be made compact.

Since the base 1 and the fitting member 6 are integrally formed through the hinge portion 20, their forming and assembly become easy.

Incidentally, the base 1 and the fitting member 6 may be shaped by bending an iron sheet or the like, but if they are molded from the synthetic resin as in this embodiment, they are free from possible rust. If the base 1 and the fitting member 6 are shaped by bending the iron sheet, the bent portion between the base 1 and the fitting member 6 (that corresponds to the hinge portion 20 in this embodiment) will be bent repeatedly to adjust the angle of the base 1 and will be broken, or cracks will occur at the bent portion at the time of shaping when it is bent only once. If the base 1 and the fitting member 6 are molded integrally from the synthetic resin, breakage is difficult to occur in the hinge portion 20 that connects them together.

What is claimed is:

1. In a hinge of the type wherein a rotor is connected to be rotatable to a front part of a base by first and second link arms, said base is supported by a set screw on a fitting member which is mounted on a body of furniture and at least one of said link arms is urged so as to keep said rotor closed, the improvement characterized in that an extension portion having a cam surface is formed at the end portion of one of said link arms on the side of said base, a frame member pushing said cam surface of one of said link arms is movably supported inside said base in such a manner as to encompass said set screw, and a spring urging forward said frame member is disposed at the back of said frame member inside said base.

2. The hinge as defined in claim 1 wherein said frame is supported by said base through the engagement of a pair of support shaft portions formed on said frame member and a pair of elongated holes formed on said base, and said base has a pair of groove portions which reach one of the end portions of said elongated holes and through which said support shaft portions of said frame member pass when said frame member is assembled to said base.

3. The hinge as defined in claim 2 wherein the contact point of said cam surface of one of said link arms with said frame member and the point of action of said spring on said frame member are positioned in such a relation that said support shaft portions of said frame member are urged in the direction opposite said groove portions in said elongated holes.

4. The hinge as defined in claim 1 wherein said base and said fitting member are integrally molded from a synthetic resin and are connected rotatably to each other by a hinge portion having a reduced thickness.

* * * * *